US008604993B2

(12) United States Patent
Yosui et al.

(10) Patent No.: US 8,604,993 B2
(45) **Date of Patent: *Dec. 10, 2013**

(54) ANTENNA COIL TO BE MOUNTED ON A CIRCUIT BOARD AND ANTENNA DEVICE

(75) Inventors: Kuniaki Yosui, Kanazawa (JP); Hiroyuki Kubo, Kusatsu (JP); Hiromitsu Ito, Hakusan (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/161,533

(22) Filed: Jun. 16, 2011

(65) Prior Publication Data

US 2011/0241958 A1 Oct. 6, 2011

Related U.S. Application Data

(63) Continuation of application No. 12/870,891, filed on Aug. 30, 2010, now Pat. No. 7,990,331, which is a continuation of application No. 11/834,901, filed on Aug. 23, 2007, now Pat. No. 7,812,777, which is a continuation of application No. PCT/JP2007/055069, filed on Mar. 14, 2007.

(30) Foreign Application Priority Data

| | | |
|---|---|---|
| Jul. 7, 2006 | (JP) | 2006-187484 |
| Jul. 20, 2006 | (JP) | 2006-198253 |
| Feb. 26, 2007 | (JP) | 2007-045422 |

(51) Int. Cl.
*H01Q 7/08* (2006.01)

(52) U.S. Cl.
USPC ..... 343/788; 343/787

(58) Field of Classification Search
USPC ..... 343/788, 787, 741, 866, 867, 742
See application file for complete search history.

(56) References Cited

U.S. PATENT DOCUMENTS

| | | | | |
|---|---|---|---|---|
| 4,148,036 | A * | 4/1979 | Miller | 343/788 |
| 7,046,200 | B2 * | 5/2006 | Furuya | 343/700 MS |
| 7,812,777 | B2 * | 10/2010 | Yosui et al. | 343/788 |
| 7,990,331 | B2 * | 8/2011 | Yosui et al. | 343/788 |
| 2003/0226892 | A1 * | 12/2003 | Arimura | 235/439 |

(Continued)

FOREIGN PATENT DOCUMENTS

| | | | |
|---|---|---|---|
| JP | 08-204432 | A | 8/1996 |
| WO | WO 2005088767 | A1 * | 9/2005 |

OTHER PUBLICATIONS

Yosui et al.; "Antenna Coil to be Mounted on a Circuit Board and Antenna Device"; U.S. Appl. No. 11/843,901, filed Aug. 23, 2007.

(Continued)

*Primary Examiner* — Dieu H Duong
(74) *Attorney, Agent, or Firm* — Keating & Bennett, LLP

(57) ABSTRACT

In an antenna coil including a first magnetic core, a second magnetic core, and a flexible board, coil conductors are provided on a surface of the flexible board. By winding the flexible board around the first magnetic core and the second magnetic core, a first coil portion is disposed around the first magnetic core, and a second coil portion is disposed around the second magnetic core. The winding direction of the second coil portion is opposite to that of the first coil portion. The first coil portion and the second coil portion are connected to define one coil as a whole.

20 Claims, 15 Drawing Sheets

(56) References Cited

U.S. PATENT DOCUMENTS

| | | | | |
|---|---|---|---|---|
| 2004/0061660 | A1* | 4/2004 | Yoshida et al. | 343/788 |
| 2004/0183743 | A1* | 9/2004 | Reasoner et al. | 343/895 |
| 2005/0179552 | A1 | 8/2005 | Shoji et al. | |
| 2006/0214866 | A1* | 9/2006 | Araki et al. | 343/788 |
| 2007/0195001 | A1* | 8/2007 | Ueda | 343/788 |

OTHER PUBLICATIONS

Yosui et al.; "Antenna Coil to be Mounted on a Circuit Board and Antenna Device"; U.S. Appl. No. 12/870,891, filed Aug. 30, 2010.

Official Communication issued in corresponding European Patent Application No. 11173489.3, mailed on Nov. 29, 2012.

* cited by examiner

ANTENNA COIL TO BE MOUNTED ON A CIRCUIT BOARD AND ANTENNA DEVICE

BACKGROUND OF THE INVENTION

1. Field of the Invention

The present invention relates to an antenna coil to be mounted on a circuit board for use in an RFID (radio frequency identification) system that performs communication with an external apparatus via an electromagnetic signal, and also relates to an antenna device including such an antenna coil.

2. Description of the Related Art

In RFID systems that have recently been in increasing use, an antenna for information communication is mounted in each of a mobile electronic device, such as a mobile phone, and a reader/writer so that data is exchanged between the mobile electronic device and the reader/writer. In particular, there is a strong demand for an antenna mounted in a mobile electronic device to achieve high performance, low cost, and small size. In order to meet this demand, an antenna coil is used.

For example, Patent Document 1 (Japanese Unexamined Patent Application Publication No. H11-122146), discloses an antenna mounted in a mobile electronic device. FIG. 17 is a perspective view showing a configuration of the antenna device described in Patent Document 1. A coil that forms an information communication antenna 102 mounted on a board 101 includes a plurality of segments 102*a* and 102*b*. Each segment includes a magnetic core and a coil wound around the magnetic core. The coil of the first segment 102*a* is wound left-handed, and the coil of the second segment 102*b* is wound right-handed. The coil of the first segment 102*a* and the coil of the second segment 102*b* are connected to each other. A portion where a coil conductor is not provided (hereinafter referred to as a non-winding portion) is provided between the segments 102*a* and 102*b*. When the antenna coil 102 is mounted in this way, a magnetic flux that is perpendicular to the board is bent about 90° after entering the non-winding portion, and is then guided to the first segment 102*a* and the second segment 102*b*. When the magnetic flux passes through the coil axes of the coils of the segments 102*a* and 102*b*, voltages are induced in the coils, and communication is allowed.

The above-described antenna coil 102 functions as an antenna because magnetic flux entering the coil-conductor non-winding portion is guided to the segments 102*a* and 102*b*. If the non-winding portion is small, a sufficient magnetic flux cannot be captured. In contrast, if the non-winding portion is too large, the magnetic flux is not guided to the segments 102*a* and 102*b*. In each case, the magnetic flux does not pass through the coil axes of the coils of the segments 102*a* and 102*b*, and electromagnetic induction does not occur. Therefore, the segments 102*a* and 102*b* need to be arranged with a fixed space therebetween.

Unfortunately, in the configuration described in Patent Document 1, when the antenna coil 102 is mounted on the board 101 of the mobile electronic device, the segments 102*a* and 102*b* that constitute the antenna coil 102 are fixed separately. For this reason, it is necessary to finely adjust the fixing positions so that the distance between the segments is fixed. This adjustment needs many steps. Further, when the distance between the segments varies in accordance with the fixing positions, an expected antenna sensitivity is not achieved, depending on the structure of the mobile electronic device in which the antenna is mounted.

SUMMARY OF THE INVENTION

In order to overcome the problems described above, preferred embodiments of the present invention provide an antenna coil to be mounted on a circuit board that is easy to mount and that prevents antenna sensitivity from varying according to the mounting position.

In addition, preferred embodiments of the present invention provide an antenna device that is highly sensitive to external magnetic flux.

In order to overcome the above-described problems, an antenna coil to be mounted on a circuit board according to a preferred embodiment of the present invention includes a first magnetic core shaped like a flat plate; a second magnetic core shaped like a flat plate and juxtaposed to the first magnetic core with a space therebetween; one flexible board wound around the two magnetic cores and having a conductor on a surface thereof; a first coil portion disposed around the first magnetic core by the conductor; a second coil portion disposed around the second magnetic core by the conductor such that a coil axis direction of the second coil portion coincides with a coil axis direction of the first coil portion, and such that a coil winding direction of the second coil portion is opposite to a coil winding direction of the first coil portion; and a connecting conductor defined by the conductor so as to connect the first coil portion and the second coil portion.

It is effective for the antenna coil to satisfy the condition that $0.6A \geq B \geq 0.4A$ where A represents the length of the antenna coil in the coil axis direction and B represents the distance between the first magnetic core and the second magnetic core.

Preferably, the first magnetic core and the second magnetic core have the same shape.

Preferably, the first magnetic core and the second magnetic core are juxtaposed so that principal surfaces thereof face in the same direction.

Preferably, a magnetic core is connected to at least one of the outer ends of the first and second magnetic cores in the coil axis direction.

The first coil portion and the second coil portion may be equal or different in the number of coil turns.

Two or more connecting conductors can be provided to connect the first coil portion and the second coil portion.

An electrode can be provided on one principal surface of the antenna coil.

The antenna coil may further include a third magnetic core configured to connect the first magnetic core and the second magnetic core. A cross-sectional area of the third magnetic core that is substantially perpendicular to a direction in which the first and second magnetic cores are juxtaposed is smaller than cross-sectional areas of the first and second magnetic cores.

Preferably, a circuit board on which the antenna coil to be mounted on a circuit board having the above-described structures satisfies the condition that $Y \geq X \geq 0.8Y$ where X represents the length of the antenna coil to be mounted on a circuit board in the coil axis direction, and Y represents the distance between two intersecting points of the outer periphery of the circuit board and an imaginary line obtained by projecting the center line of the antenna coil to be mounted on a circuit board in the coil axis direction on the circuit board.

Preferably, a distance D1 between x1 and y1 is equal to a distance D2 between x2 and y2 where x1 and x2 represent two intersecting points of the imaginary line and end surfaces of the antenna coil to be mounted on a circuit board in the coil axis direction, y1 represents one intersecting point close to x1, of the two intersecting points of the imaginary line and the outer periphery of the circuit board, and y2 represents the other intersecting point close to x2.

Preferably, the antenna coil to be mounted on a circuit board is mounted on the circuit board with a space therebetween, and the electrode is provided on a surface of the antenna coil facing the circuit board.

Preferred embodiments of the present invention provide the following advantages with the above-described structures.

Since the flexible board is wound around the first magnetic core and the second magnetic core so as to define the antenna coil to be mounted on a circuit board having the first and second coil portions, the area of a non-winding portion provided between the first and second coil portions is fixed. Therefore, it is possible to achieve an antenna coil having a fixed antenna sensitivity, regardless of the mounting method on the board.

In the antenna device in which the antenna coil is mounted, the antenna coil is mounted so as to satisfy the condition that $Y \geq X \geq 0.8Y$ where X represents the length of the antenna coil in the coil axis direction, and Y represents the distance between two intersecting points of the outer periphery of the circuit board and an imaginary line obtained by projecting the center line of the magnetic core in the coil axis direction on the circuit board. Consequently, magnetic resistances are low at the ends of the antenna coil in the direction in which the first and second magnetic cores are juxtaposed. Therefore, the flux concentration effect of the antenna coil is improved, and an antenna device having a high communication sensitivity can be provided.

Other features, elements, steps, characteristics and advantages of the present invention will be described below with reference to preferred embodiments thereof and the attached drawings.

DETAILED DESCRIPTION OF PREFERRED EMBODIMENTS

First Preferred Embodiment

Figure 1A:
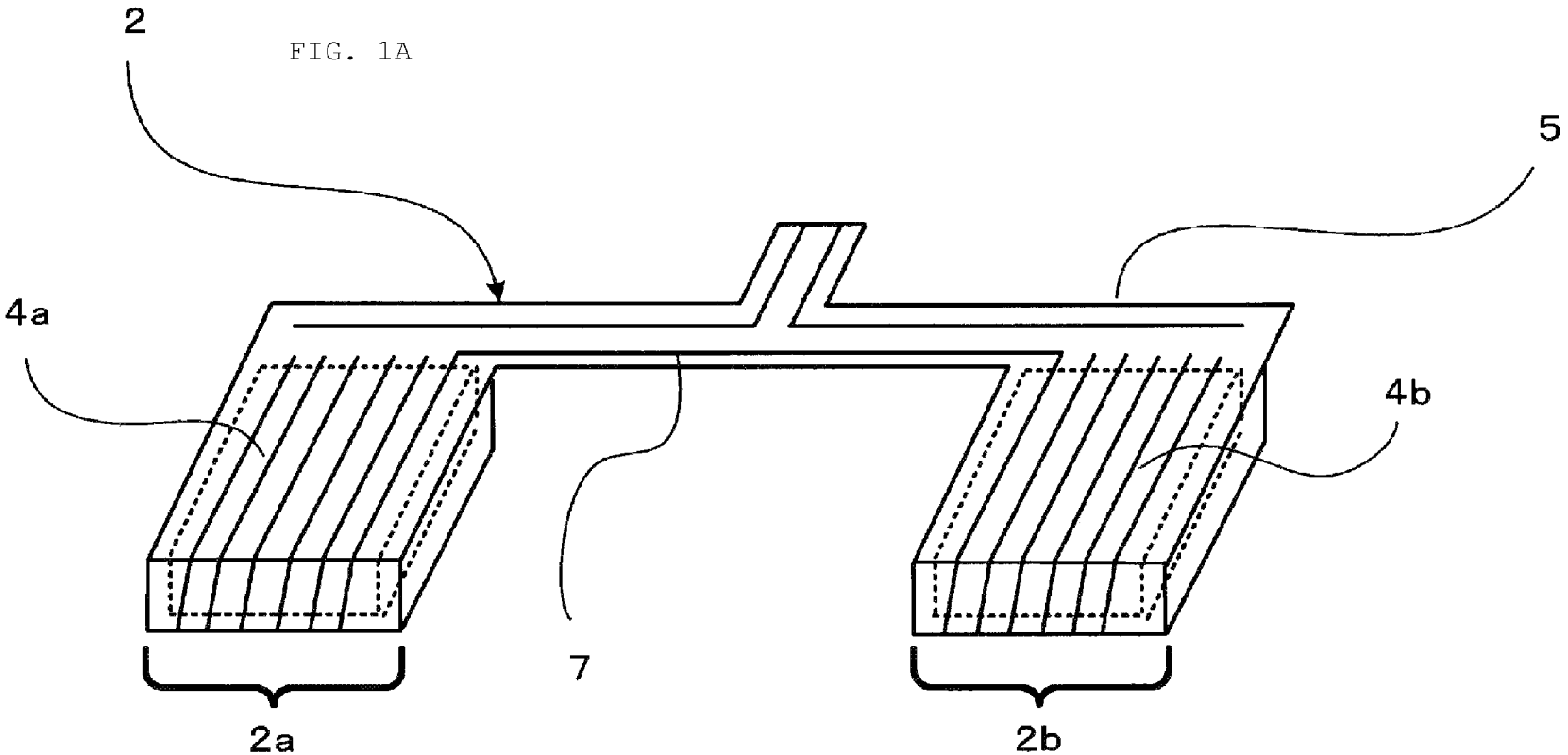
FIGS. 1A and 1B are a perspective view and a plan view, respectively, showing a structure of an antenna coil to be mounted on a circuit board according to a first preferred embodiment of the present invention.
Figure 1B:
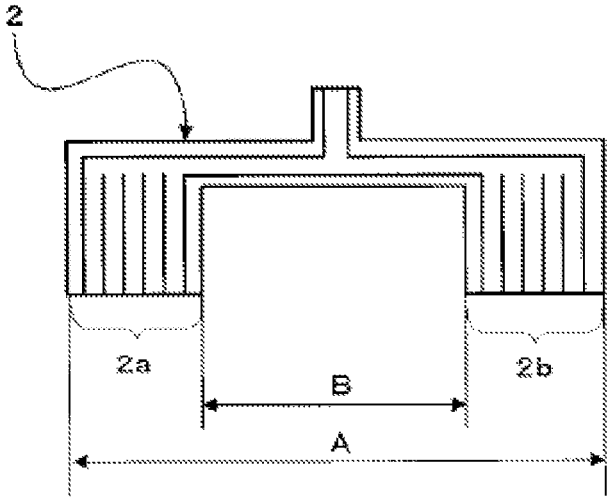
Figure 2:
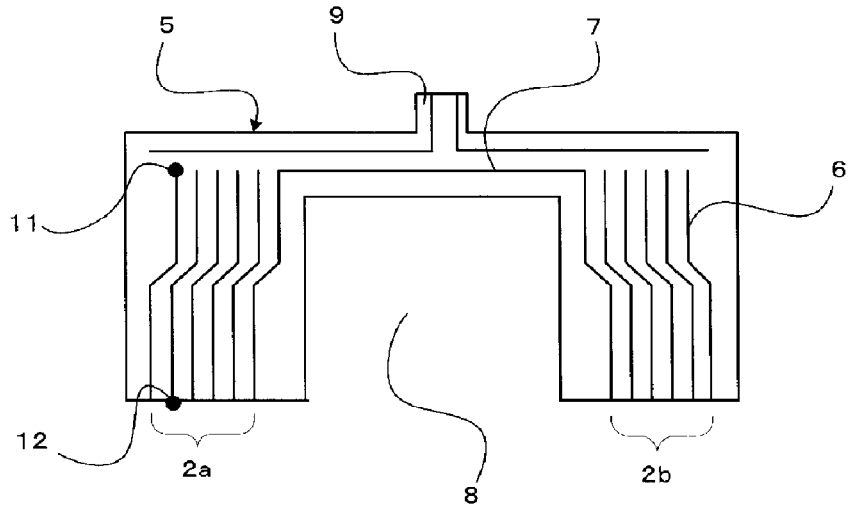
FIG. 2 is a plan view showing a structure of a flexible board before being wound around magnetic cores.

A structure of an antenna coil to be mounted on a circuit board according to a first preferred embodiment will be described with reference to FIGS. 1A, 1B and 2. FIGS. 1A and 1B are a perspective view and a plan view showing the structure of the antenna coil to be mounted on a circuit board according to the first preferred embodiment. FIG. 2 is a plan view showing a structure of a flexible board before being wound around magnetic cores.

As shown in FIGS. 1A and 1B, an antenna coil 2 according to the first preferred embodiment includes a first magnetic core 4*a*, a second magnetic core 4*b*, and one flexible board 5 wound around the first magnetic core 4*a* and the second magnetic core 4*b*. While the flexible board 5 is shown by a single line, in actuality, it has a thickness of approximately several tens of micrometers.

For example, each of the first magnetic core 4*a* and the second magnetic core 4*b* is formed of a substantially rectangular ferrite material with a principal surface having a lateral length of about 8 mm, a longitudinal length of about 10 mm, and a thickness of about 1.5 mm, for example. Lateral sides of the principal surfaces of the first and second magnetic cores 4*a* and 4*b* lie on the same straight line. The distance between the first and second magnetic cores 4*a* and 4*b* is preferably about 24 mm. A space formed between the first and second magnetic cores 4*a* and 4*b* by this arrangement is referred to as a non-winding portion.

Conductors are provided on a surface of the flexible board 5. These conductors define a first coil portion 2*a* and a second coil portion 2*b* around the first magnetic core 4*a* and the second magnetic core 4*b*, respectively. In the first coil portion 2*a*, six coil turns are preferably wound with a pitch of about 1 mm so that the first magnetic core 4*a* is exposed by about 1 mm at a lateral end on an outer side of the antenna coil and by about 2 mm at a lateral end on an inner side of the antenna coil, for example. This also applies to the second coil portion 2*b*. Coil axes of the first and second coil portions 2*a* and 2*b* thus formed are parallel or substantially parallel to the lateral direction of the first and second magnetic cores 4*a* and 4*b*. The coils of the first coil portion 2*a* and the second coil portion 2*b* are wound in opposite directions. The first coil portion 2*a* and the second coil portions 2*b* are connected in series by connecting conductors 7 so as to form one coil as a whole.

FIG. 2 shows a structure of the flexible board before being wound around the magnetic cores. The flexible board 5 has an angular U-shape in plan view, and includes an opening 8. Since the opening 8 is provided, when the flexible board is bent, as will be described below, the antenna coil 2 becomes narrow at the center in a direction in which the first and second magnetic cores 4*a* and 4*b* are arranged, in conformity with the shapes of the first magnetic core 4*a* and the second magnetic core 4*b*. A projection 9 for connection to an input/output terminal is provided on a side surface of the flexible board 5 opposite to a side surface in which the opening 8 is provided. The flexible board 5 is preferably formed of a polyimide film. Instead, the flexible board 5 can be formed of a bendable electrical insulating film such as a glass epoxy film or other resin film. Six conductors are preferably provided at each of the right and left ends of a surface of the flexible board 5 in the widthwise direction such that the opening 8 is disposed between the right and left ends. While the conductors are shown by single lines, in actuality, they preferably have a width of about 0.5 mm to about 1 mm and a thickness of about 0.05 mm to about 0.1 mm, for example. In FIG. 2 as a plan view, the conductors are in contact with a lower end of the flexible board 5, but are not in contact with an upper end thereof. A conductor adjacent to the opening 8, of the six right conductors, is connected to a conductor adjacent to the opening 8, of the six left conductors, by a connecting conductor 7 on an upper side of the opening 8. Two conductors provided at both ends of the flexible board extend to an end of the projection 9. The conductors can be formed, for example, by screen printing. The flexible board 5 having the above structure is bent with a surface having the conductors inside so that upper ends of the conductors and lower ends of the conductors are aligned and so that the first magnetic core and the second magnetic core are held in the flexible board 5. Aligned points, for example, points 11 and 12 are electrically connected by soldering. Consequently, the conductors form one coil.

When the antenna coil 2 having the above-described structure performs communication with a reader/writer for an RFID system, magnetic flux from the reader/writer enters the non-winding portion of the antenna coil 2. Therefore, the non-winding portion in which a conductor is not provided needs to be sufficiently large. However, since the magnetic flux entering the non-winding portion must pass through the first and second magnetic cores 4*a* and 4*b*, it is necessary to avoid a structure in which the magnetic flux is not easily guided to the magnetic cores because of an excessively large size of the non-winding portion. In the first preferred embodiment, the first magnetic core 4*a* and the second magnetic core 4*b* are juxtaposed, and one flexible board 5 is wound therearound. Therefore, the positional relationship between the first magnetic core 4*a* and the second magnetic core 4*b* is fixed. That is, when the antenna coil is mounted on the circuit board, antenna sensitivity of the antenna coil will not be decreased by changing the mounting position of the antenna coil in accordance with the structure of the circuit board, and this allows the antenna coil to have a fixed sensitivity. Therefore, it is possible to provide an antenna coil having a desired antenna sensitivity, regardless of the mounting method on the circuit board.

Since mounting can be performed simply by setting the integral antenna coil 2, it is fairly easy.

Regarding the size of the non-winding portion provided between the first magnetic core and the second magnetic core, the following findings were made by studies performed by the present inventors, as in experimental examples that will be described below. That is, referring to FIG. 1B, when the condition of $0.6A \geq B$ is satisfied where A represents the length of the antenna coil 2 in the coil axis direction and B represents the distance between the first and second magnetic cores, the antenna coil can properly interlink with magnetic flux from the reader/writer serving as magnetic flux that is perpendicular or substantially perpendicular to the coil axis direction of the antenna coil, and can perform highly sensitive communication.

In the first preferred embodiment, the coil-conductor non-winding portion is provided between the first magnetic core 4*a* and the second magnetic core 4*b* so that the distance B between the first and second magnetic cores 4*a* and 4*b* is about 24 mm. When the first preferred embodiment is applied to the above-described inequality, it satisfies the inequality. Therefore, the antenna coil 2 can properly interlink with the magnetic flux from the reader/writer and can perform highly sensitive communication.

In this preferred embodiment, the first coil portion 2*a* and the second coil portion 2*b* are arranged so that the magnetic cores 4*a* and 4*b* are exposed more at the lateral ends on the inner side of the antenna coil 2 than at the lateral ends on the outer side of the antenna coil 2. This structure allows the coils to be located at the ends of the antenna coil 2 where the magnetic flux concentrates. Therefore, voltage is more easily induced by magnetic flux that enters the first and second magnetic cores 4*a* and 4*b*.

In plan view, the flexible board 5 does not cover the entire non-winding portion, and the antenna coil 2 is narrow at the center in the coil axis direction. Since this reduces the contact area between the antenna coil 2 and the circuit board on which the antenna coil 2 is mounted, the antenna coil 2 can be easily mounted on the circuit board. Further, other components mounted on the circuit board can protrude from the narrow center portion of the antenna coil 2. Therefore, the degree of flexibility in designing the circuit board on which the antenna coil 2 is mounted is increased.

The first magnetic core 4*a* and the second magnetic core 4*b* that constitute the antenna coil 2 are separately provided. Therefore, the antenna coil 2 is less easily cracked by external shocks than an antenna coil that is formed by an integral magnetic core and that has a length equivalent to the total length of the antenna coil 2.

When forming the antenna coil 2, the flexible board 5 is bent with the surface having the conductors inside, and therefore, the conductors are not provided on an outer surface of the antenna coil 2. Consequently, the conductors do not easily fall off. The flexible board 5 can also be bent with the surface having the conductors outside. In this case, since the flexible board is considerably thin, even when points aligned by bending the flexible board are not bonded, they can be electrically connected by being soldered via the flexible board.

Since the first magnetic core 4*a* and the second magnetic core 4*b* have the same shape and the same size in the antenna coil 2 of this preferred embodiment, the same magnetic flux can enter each magnetic core. Further, the first coil portion 2*a* and the second coil portion 2*b* preferably include the same number of coil turns, and the coil axes thereof coincide with each other. Therefore, equal voltages can be induced in the coil portions.

While the first and second magnetic cores 4*a* and 4*b* are preferably substantially rectangular in the first preferred embodiment, the present invention is not limited to this preferred embodiment or shape. The first and second magnetic cores 4*a* and 4*b* may be shaped like a triangular prism or a cylinder, for example. Further, the first and second magnetic cores may be different in size. When a first magnetic core and a second magnetic core having an area larger than that of the first magnetic core are used, a voltage induced in a second coil portion is higher than a voltage induced in a first coil portion. With this structure, the antenna coil can interlink not only with magnetic flux that is perpendicular or substantially perpendicular to the coil axis direction of the antenna coil, but also with magnetic flux that is parallel or substantially parallel to the coil axis direction of the antenna coil. That is, when magnetic flux parallel to the coil axis direction passes through the antenna coil, voltages in opposite directions are induced in the first coil portion and the second coil portion. Since the first magnetic core and the second magnetic core are different in size, the voltages are different in volume, and are not completely cancelled each other. Therefore, even when magnetic flux parallel to the coil axis direction of the antenna coil enters, communication can be thereby performed.

This advantage can also be obtained when the number of coil turns is different between the first coil portion and the second coil portion. That is, since the number of coil turns is different between the first coil portion and the second coil portion, even when the same amount of magnetic flux passes through the first magnetic core and the second magnetic core, voltages having different volumes are induced therein, and the voltages in opposite directions do not cancel each other.

While the coil axes of the first coil portion 2*a* and the second coil portion 2*b* coincide with each other in the first preferred embodiment, even when they do not completely coincide, magnetic flux that is perpendicular or substantially perpendicular to the coil axis direction of the antenna coil can be guided to the coil portions. Further, while the flexible board 5 has the projection 9 for connection to the input/output terminal in the first preferred embodiment, the manner of connecting the first coil portion and the second coil portion to the input/output terminal is not limited to that adopted in this preferred embodiment. The connection of the first coil portion 2*a* and the second coil portion 2*b* is not limited to series connection. The first and second coil portions 2*a* and 2*b* can be connected in parallel by changing the connecting position and connecting method.

Second Preferred Embodiment

Figure 3B:
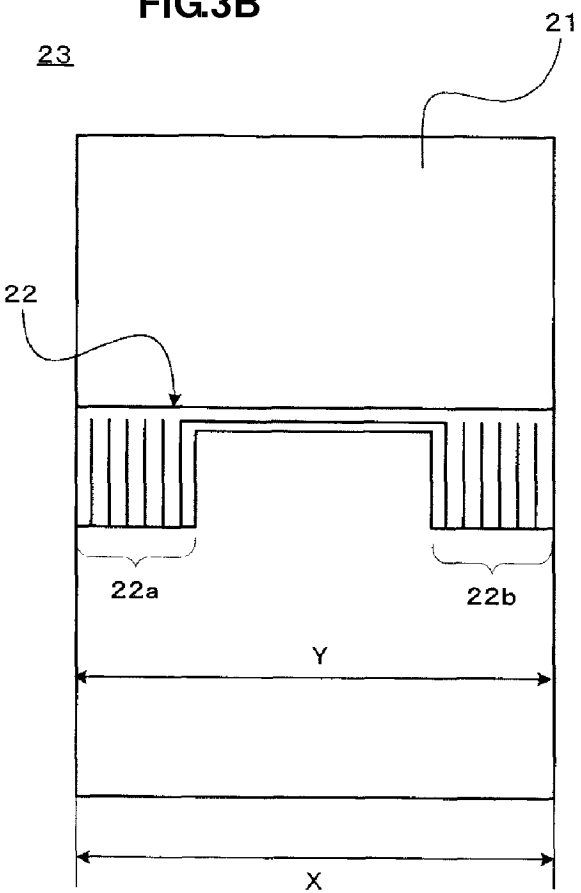
FIGS. 3A and 3B are a perspective view and a plan view, respectively, showing a configuration of an antenna device in which an antenna coil to be mounted on a circuit board according to a second preferred embodiment of the present invention is mounted.
Figure 3A:
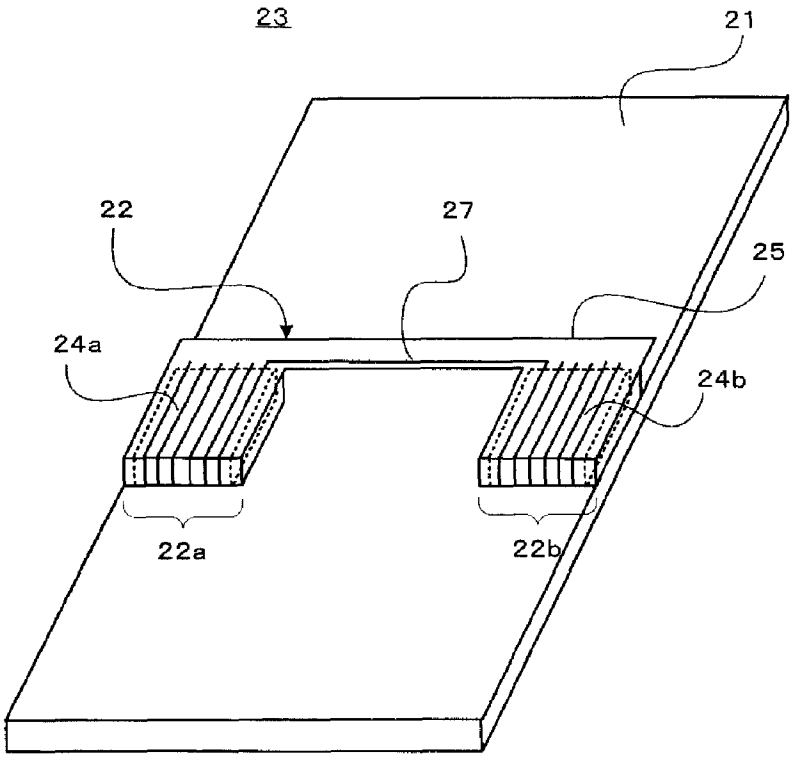
Figure 4:
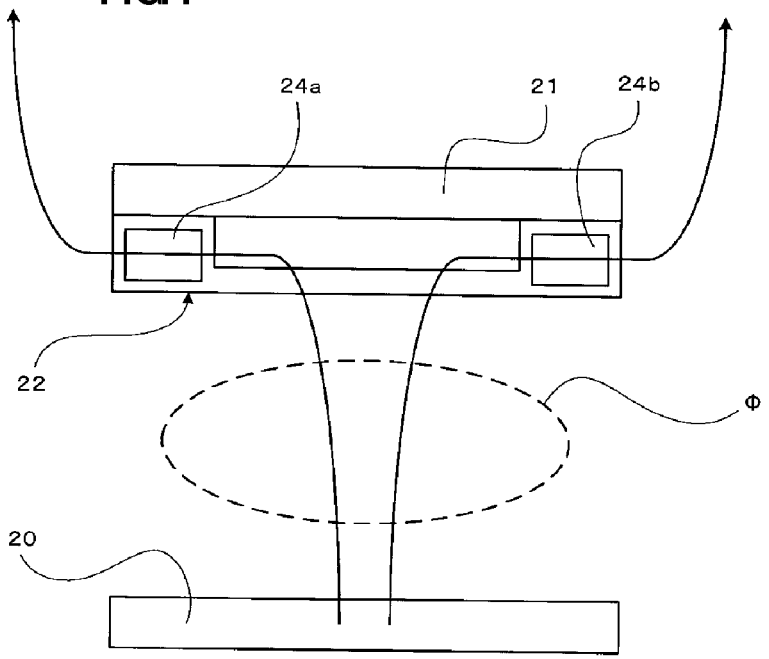
FIG. 4 is a schematic view showing a magnetic flux path made in a state in which the antenna device shown in FIGS. 3A and 3B is held over a reader/writer for an RFID system.

A configuration of an antenna device in which an antenna coil to be mounted on a circuit board according to a second embodiment is mounted on a circuit board will be described with reference to FIGS. 3A, 3B and 4. FIGS. 3A and 3B are a perspective view and a plan view, respectively, showing the configuration of the antenna device in which the antenna coil to be mounted on a circuit board of the second preferred embodiment is mounted. FIG. 4 is a schematic view showing a magnetic flux path formed in a state in which the antenna device shown in FIGS. 3A and 3B is held over a reader/writer for an RFID system.

As shown in FIG. 3A, an antenna coil 22 is mounted on a circuit board 21 in an antenna device 23 according to the second preferred embodiment. For example, the circuit board 21 preferably has a substantially rectangular principal surface having a length of about 90 mm and a width of about 40 mm, for example. The lateral length of the antenna coil 22 coincides with the width of the circuit board 21. The antenna coil 22 is mounted so that lateral ends of the antenna coil 22 coincide with ends of the circuit board 21 in the widthwise direction. The antenna coil 22 is fixed to the circuit board 21 with adhesive.

Since the antenna coil 22 is formed similarly to the first preferred embodiment, a description thereof will be omitted. In the second preferred embodiment, however, a projection for connection to an input/output terminal is not provided, and ends of conductors provided on a flexible board are connected to ends of conductors provided on the circuit board by soldering. The antenna coil 22 is mounted on the circuit board 21 so that the principal surface of the circuit board 21 faces principal surfaces of first and second magnetic cores 24*a* and 24*b*, so that the lateral sides of first and second magnetic cores 24*a* and 24*b* lie on the same straight line, and so that the lateral direction of the first and second magnetic cores 24*a* and 24*b* is parallel or substantially parallel to the widthwise direction of the circuit board 21.

Advantages obtained by mounting the antenna coil 22 on the circuit board 21 will be described below.

In FIG. 4, $\phi$ represents magnetic flux from the reader/writer. When an antenna device is mounted in a mobile terminal, it is normally arranged so that the principal surface of the mobile terminal is parallel or substantially parallel to a circuit board of the antenna device. Further, a user holds the mobile terminal so that the principal surface of the mobile terminal is parallel or substantially parallel to the principal surface of the reader/writer. FIG. 4 shows a path of magnetic flux from a reader/writer 20 in this usage manner, and a cross-sectional structure of the antenna device. As shown in FIG. 4, magnetic flux $\phi$ from the reader/writer 20 enters a coil-conductor non-winding portion provided between the first magnetic core 24*a* and the second magnetic core 24*b* in the antenna coil 22. The entering magnetic flux is blocked by the circuit board 21 provided behind the antenna coil 22, and its traveling direction is bent about 90°. Then, the magnetic flux passes through the first magnetic core 24*a* and the second magnetic core 24*b*. Since the magnetic flux $\phi$ from the reader/writer travels in this way, even when the coil axis of the antenna coil 22 is orthogonal to the magnetic flux $\phi$ from the reader/writer 20, the antenna coil 22 can capture and interlink with the magnetic flux $\phi$ from the reader/writer 20, thus causing electromagnetic induction. Particularly, in this preferred embodiment, since a first coil portion 22*a* and a second coil portion 22*b* are respectively provided centered on the first magnetic core 24*a* and the second magnetic core 24*b*, the magnetic flux passes through the coil axes of the coil portions. Therefore, voltages are easily induced by the passage of the magnetic flux through the first and second magnetic cores 24*a* and 24*b*.

When the magnetic flux $\phi$ from the reader/writer passes through the first magnetic core 24*a* and the second magnetic core 24*b*, it passes through the coil axes of the first coil portion 22*a* and the second coil portion 22*b*, and voltages are produced in the coil portions. Since the magnetic flux enters between the first coil portion 22*a* and the second coil portion 22*b*, magnetic fluxes in opposite directions respectively pass through the coil axes of the coil portions. However, since the coil winding direction of the first coil portion 22*a* is opposite to that of the second coil portion 22*b*, voltages are produced in the same direction. Even when the first coil portion 22*a* and the second coil portion 22*b* are connected by a connecting conductor 27, the voltages do not cancel each other.

By making the number of coil turns equal between the first coil portion 22*a* and the second coil portion 22*b*, the antenna coil can be made symmetrical laterally. Moreover, it is possible to easily satisfy the condition that the highest sensitivity be obtained in a state in which the center of the antenna coil 22 is aligned with the center of the reader/writer 20.

In the antenna device 23 of this preferred embodiment, the antenna coil 22 is mounted so that X equals Y where X represents the width of the principal surface of the circuit board 21 and Y represents the length of the antenna coil 22 in the coil axis direction, as shown in FIG. 3B. According to the findings of preferred embodiments of the present inventors, when the antenna coil 22 is arranged on the circuit board 21 so that $X \geq Y \geq 0.8X$, the ends of the antenna coil 22 in the coil axis direction are disposed close to the ends of the circuit board 21, and are not easily influenced by the conductors on the circuit board. Since the magnetic resistances at the ends of the antenna coil 22 in the coil axis direction can be thereby reduced, the flux concentrating force of the antenna coil is increased, and the antenna device can have a high communication sensitivity. The second preferred embodiment satisfies the above-described inequality. For this reason, the antenna coil can properly interlink with the magnetic flux from the reader/writer.

In this preferred embodiment, the antenna coil 22 is arranged so that the ends of the antenna coil 22 in the coil axis direction coincide with the ends of the circuit board 21 in the widthwise direction. That is, a distance D1 between x1 and y1 equals a distance D2 between x2 and y2 where x1 and x2 represent two intersecting points of an imaginary line, which is obtained by projecting the center line of the antenna coil 22 in the coil axis direction on the circuit board 21, and end surfaces of the antenna coil 22 in the coil axis direction, y1 represents one intersecting point close to x1, of two intersecting points of the imaginary line and the outer periphery of the circuit board 21, and y2 represents the other intersecting point close to x2. While D1=D2=0 in this preferred embodiment, D1 and D2 do not always need to be 0. This allows magnetic resistances at the ends of the antenna coil 22 in the coil axis direction to be equal, and allows the magnetic fluxes passing through the first and second magnetic cores 24*a* and 24*b* to be equal.

While the antenna coil 22 and the circuit board 21 are bonded together with adhesive in the antenna device 23 of the second preferred embodiment, the method for mounting the antenna coil on the circuit board is not limited thereto.

Third Preferred Embodiment

In an antenna coil to be mounted on a circuit board according to a third preferred embodiment, magnetic cores are connected to ends of a first magnetic core and a second magnetic core on both outer sides in the coil axis direction. Structures of the antenna coil that will not be described in the following examples conform to those adopted in the first preferred embodiment. However, a projection for connection to an input/output terminal is not provided.

First Example

Figure 5:
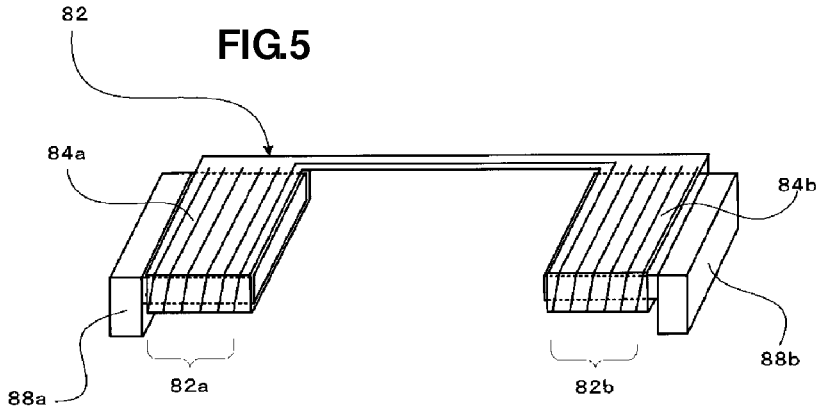
FIG. 5 is a perspective view showing a structure of an antenna coil according to a third preferred embodiment of the present invention.

FIG. 5 shows a structure of an antenna coil 82 in which magnetic cores 88*a* and 88*b* extending in a direction that is perpendicular or substantially perpendicular to the coil axis direction of the antenna coil 82 are respectively provided at ends of a first magnetic core 84*a* and a second magnetic core 84*b*. The connected magnetic cores 88*a* and 88*b* preferably are about 10 mm in longitudinal length, about 1.5 mm in lateral length, and about 2.3 mm in thickness, for example. The magnetic core 88*a* is bonded to an end surface of the first magnetic core 84*a* in the coil axis direction. A longitudinal side of the magnetic core 88*a* coincides with a longitudinal side of the first magnetic core 84, and lateral sides of the magnetic core 88*b* and lateral sides of the first magnetic core 84*a* lie on the same straight line. Similarly, the magnetic core 88*b* is bonded to an end surface of the second magnetic core 84*b*.

With this structure, when the antenna coil 82 of the first example is mounted on a circuit board having a substantially rectangular shape, it can be formed in accordance with the shape of the circuit board. This can reduce the size of the antenna device including the antenna coil and the circuit board.

Second Example

Figure 6:
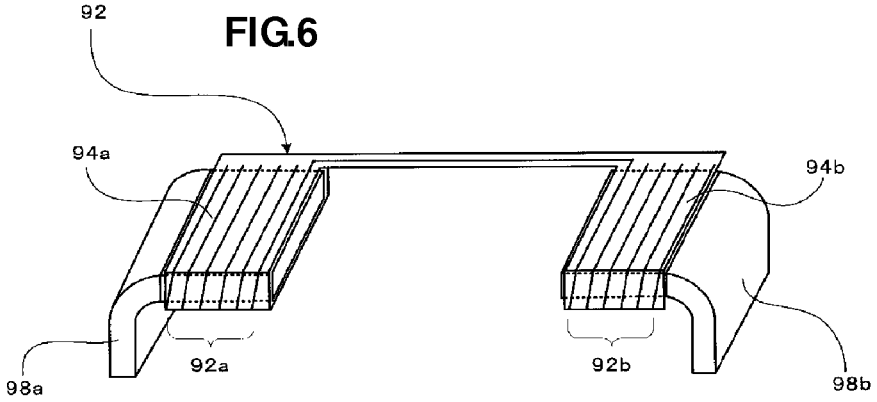
FIG. 6 is a perspective view showing a structure of an antenna coil according to the third preferred embodiment of the present invention.

FIG. 6 shows a structure of an antenna coil 92 in which arc-shaped magnetic cores 98*a* and 98*b* are connected to end surfaces of the antenna coil 92 in the coil axis direction. An end surface of the magnetic core 98*a* connected to a first magnetic core 94*a* preferably has the same size and shape as those of an end surface of the first magnetic core in the coil axis direction, and the end surfaces are bonded together so as to completely coincide with each other. Similarly, the magnetic core 98*b* is bonded to an end surface of a second magnetic core 94*b*.

This structure can further increase the area of surfaces from which magnetic flux is radiated. Therefore, antenna sensitivity can be enhanced further.

Advantages obtained by the antenna coil to be mounted on a circuit boards having the structures in the above-described first and second examples will be described below. Magnetic flux entering inner side surfaces of the first and second magnetic cores passes through the first and second coil portions. Further, the magnetic flux passes through the magnetic cores connected to the first and second magnetic cores, and is then radiated from the side surfaces into the space. Since the magnetic cores are provided at the ends of the antenna coil and the side surfaces of the magnetic cores from which the magnetic flux is radiated into the space are wide in this preferred embodiment, magnetic resistances at the ends of the antenna coil are low. Consequently, the magnetic flux that enters the antenna coil and passes through the first and second coil portions to cause electromagnetic induction is increased, and more sensitive communication is possible.

The above-described advantages are not obtained only in the first and second examples. It is satisfactory as long as magnetic cores are connected to ends of the first and second magnetic cores on both outer sides of the antenna coil in the coil axis direction. Herein, "connection" includes not only a structure in which the magnetic cores are added to the ends of the first and second magnetic cores, but also a structure in which the magnetic cores are provided integrally with the first and second magnetic cores and a structure in which the magnetic cores are formed by bending the first and second magnetic cores.

When the ends of the magnetic cores connected to the ends of the first and second magnetic cores are placed outside the circuit board in plan view, the influence of the conductors on the circuit board is reduced, and magnetic resistances can be reduced. Therefore, the flux concentrating force of the antenna coil is increased, and the antenna device can have a high communication sensitivity.

Fourth Preferred Embodiment

In an antenna device in which an antenna coil to be mounted on a circuit board according to a fourth preferred embodiment is mounted, a first magnetic core and a second magnetic core are connected by a third magnetic core. When the third magnetic core is provided, the cross-sectional area of the third magnetic core that is parallel or substantially parallel to the longitudinal direction of the first and second magnetic cores needs to be smaller than those of the first and second magnetic cores. Structures of the antenna coil and the circuit board that will not be described in the following examples conform to those adopted in the first and second preferred embodiments. Therefore, since a flexible board is wound around the first magnetic core and the second magnetic core in the antenna coil of this preferred embodiment, the area of a non-winding portion provided between the first and second coil portions is fixed. For this reason, a fixed antenna sensitivity can be achieved, regardless of the mounting method on the circuit board. Further, in the antenna device of this preferred embodiment, the antenna coil is mounted on the circuit board so as to satisfy the condition that $Y \geq X \geq 0.8Y$ where X represents the length of the antenna coil in the coil axis direction and Y represents the distance between two intersecting points of an imaginary line, which is obtained by projecting the center line of the magnetic core in the coil axis direction on the circuit board, and the outer periphery of the circuit board. Therefore, magnetic resistances are low at ends of the antenna coil in a direction in which the first and second magnetic cores are arranged, the flux concentration effect of the antenna coil is enhanced, and the antenna device functions with a high communication sensitivity.

First Example

Figure 7:
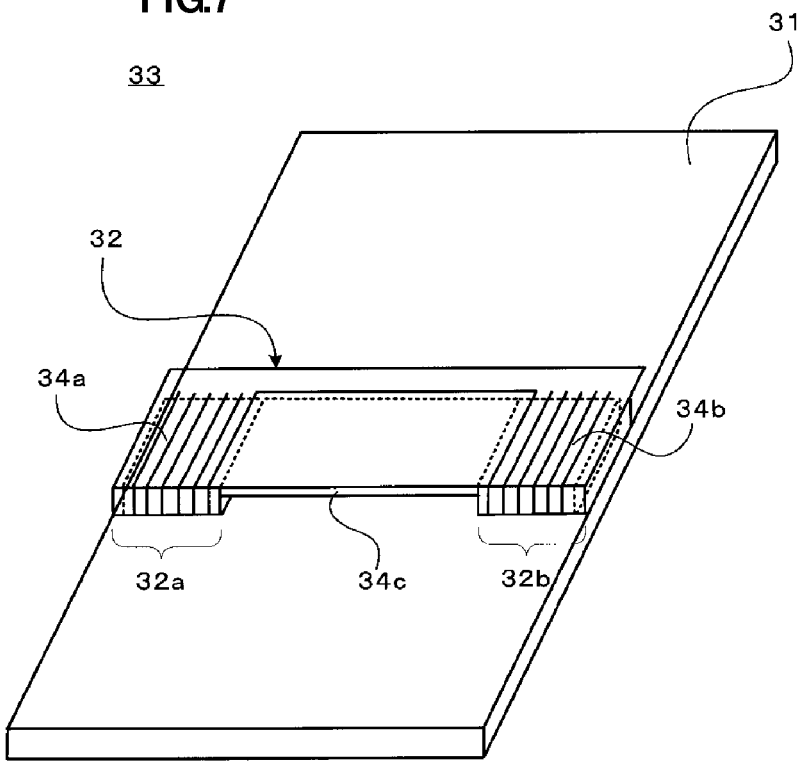
FIG. 7 is a perspective view showing a configuration of an antenna device according to a fourth preferred embodiment of the present invention.

FIG. 7 shows a configuration of an antenna device 33 using an antenna coil 32 in which a third magnetic core 34*c* is thinner than a first magnetic core 34*a* and a second magnetic core 34*b*. In FIG. 7, when principal surfaces of the magnetic cores 34*a*, 34*b*, and 34*c* facing a circuit board 31 are referred to as first principal surfaces and principal surfaces opposite to the first principal surfaces are referred to as second principal surfaces, the second principal surfaces of the first, second, and third magnetic cores 34*a*, 34*b*, and 34*c* are provided on the same plane. In contrast, the first principal surfaces of the first and second magnetic cores 34*a* and 34*b* are provided on the same plane, but the first principal surface of the third magnetic core 34*c* is provided on a different plane. Since the third magnetic core 34*c* is thin, a gap is formed between the third magnetic core 34*c* and the circuit board 31. In this case, the gap is formed between the third magnetic core 34*c* and the circuit board 31, and a space formed thereby can be used effectively.

Second Example

Figure 8:
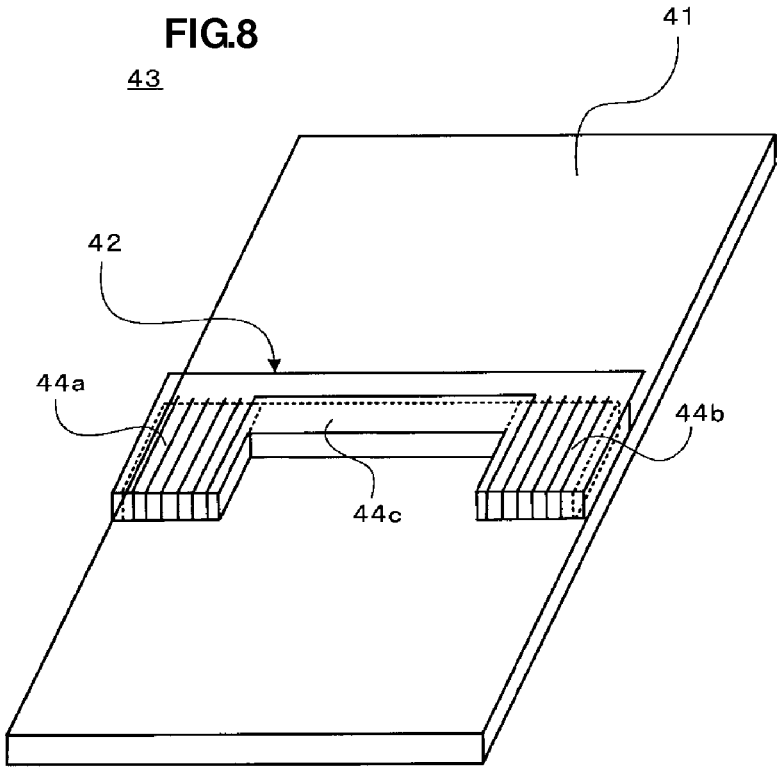
FIG. 8 is a perspective view showing a configuration of an antenna device according to the fourth preferred embodiment of the present invention.

FIG. 8 shows a configuration of an antenna device 43 using an antenna coil 42 in which the longitudinal length of a third magnetic core 44*c* is smaller than the longitudinal lengths of a first magnetic core 44*a* and a second magnetic core 44*b*. In FIG. 8, one-side lateral surfaces of the first, second, and third magnetic cores 44*a*, 44*b*, and 44*c* are provided on the same plane. Although other-side surfaces of the first and second magnetic cores 44*a* and 44*b* are provided on the same plane, an other-side surface of the third magnetic core 44*c* is provided on a different plane. By setting the longitudinal length of the third magnetic core 44*c* to be smaller than the longitudinal lengths of the first and second magnetic cores 44*a* and 44*b*, the antenna coil 42 is made narrow in the lateral center. Since the contact area between the antenna coil 42 and a circuit board 41 is thereby decreased, the antenna coil 42 can be easily mounted on the circuit board 41. Further, since other components provided on the circuit board 41 may protrude from the center narrow portion of the antenna coil 42, the degree of flexibility in designing the circuit board 41 on which the antenna coil 42 is mounted is increased.

Third Example

Figure 9:
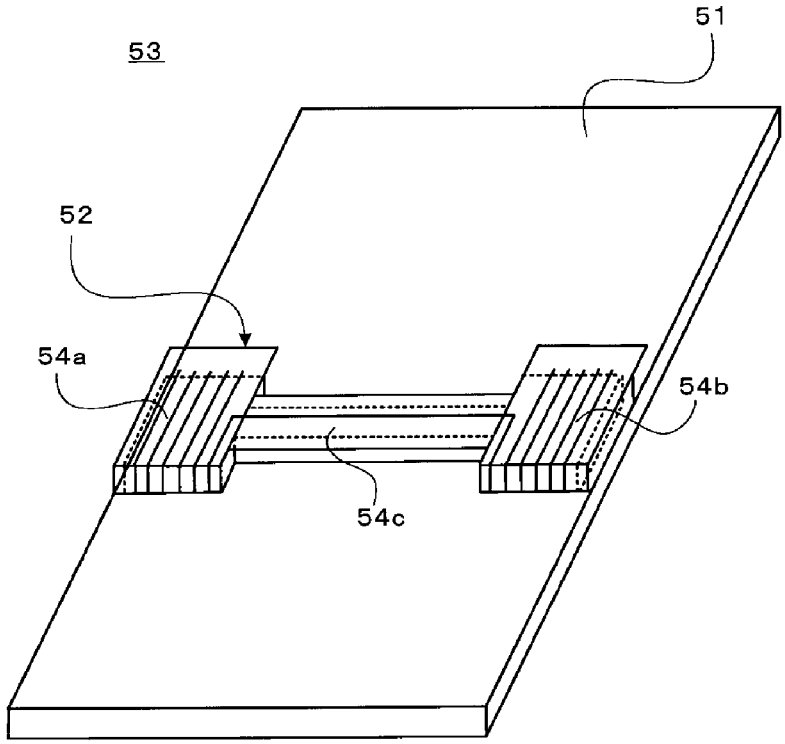
FIG. 9 is a perspective view showing a configuration of an antenna device according to the fourth preferred embodiment of the present invention.

FIG. 9 shows a configuration of an antenna device 53 using an antenna coil 52 in which the longitudinal length of a third magnetic core 54*c* is smaller than the longitudinal lengths of a first magnetic core 54*a* and a second magnetic core 54*b*. Both lateral side surfaces of the third magnetic core 54*c* are provided on a plane different from a plane on which side surfaces of the first and second magnetic cores 54*a* and 54*b* are provided. By setting the longitudinal length of the third magnetic core 54*c* to be smaller than the longitudinal lengths of the first and second magnetic cores 54*a* and 54*b*, the antenna coil 52 is made narrow in the lateral center. Since the contact area between the antenna coil 52 and the circuit board 51 is thereby reduced, the antenna coil 52 can be easily placed on the circuit board 51. Further, since other components provided on the circuit board 51 may protrude from the center narrow portion of the antenna coil 52, the degree of flexibility in designing the circuit board 51 on which the antenna coil 52 is mounted is increased.

Fourth Example

Figure 10:
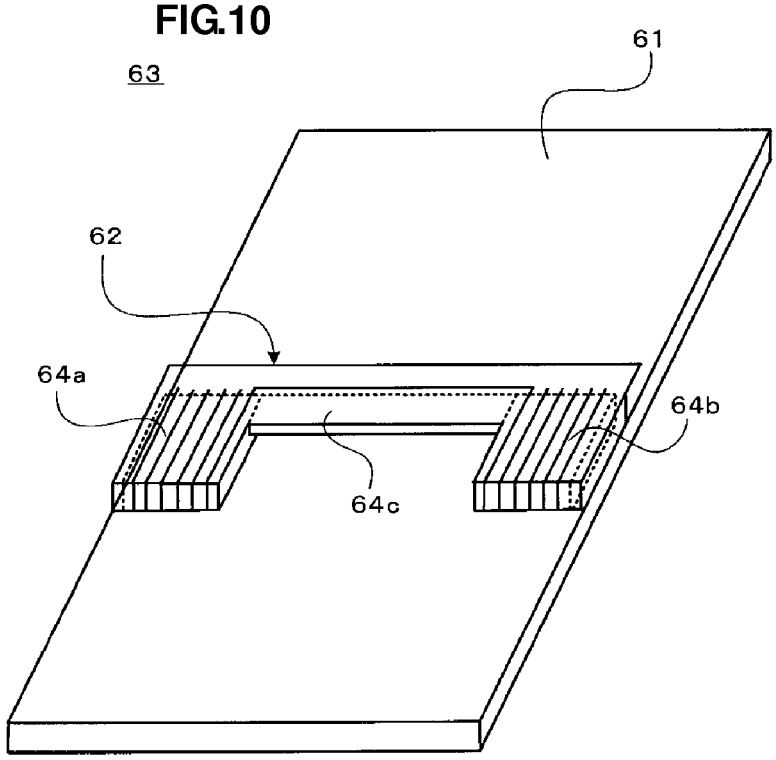
FIG. 10 is a perspective view showing a configuration of an antenna device according to the fourth preferred embodiment of the present invention.

FIG. 10 shows a structure of an antenna coil 62 including a third magnetic coil 64*c* that is thinner and shorter in the longitudinal direction than a first magnetic core 64*a* and a second magnetic core 64*b*. In this case, a gap is formed between the third magnetic core 64*c* and a circuit board 61, and a resulting space can be used effectively. Moreover, the antenna coil 62 is narrow in the lateral center. Since the contact area between the antenna coil 62 and the circuit board 61 is thereby reduced, the antenna coil 62 can be easily placed on the circuit board 61. Further, since other components provided on the circuit board 61 may protrude from the center narrow portion of the antenna coil 62, the degree of flexibility in designing the circuit board 61 on which the antenna coil 62 is mounted is increased.

In the above-described structures in the first to fourth examples, since the third magnetic core is provided and the magnetic core is provided in a non-winding portion, the flux concentration effect of the antenna coil is improved. Therefore, antenna sensitivity increases. Further, since the cross-sectional area of the third magnetic core parallel to the longitudinal direction of the first and second magnetic cores is smaller than those of the first and second magnetic cores, the contact area between the third magnetic core and the circuit board can be decreased, and the antenna coil is easily mounted on the circuit board. While the first magnetic core and the third magnetic core, and the second magnetic core and the third magnetic core are bonded in the above-described preferred embodiments, the flux concentration effect of the antenna coil can be improved as long as the magnetic cores are magnetically connected without being bonded. In addition, the first magnetic core, the second magnetic core, and the third magnetic core can be molded integrally.

Experimental Examples

Figure 11:
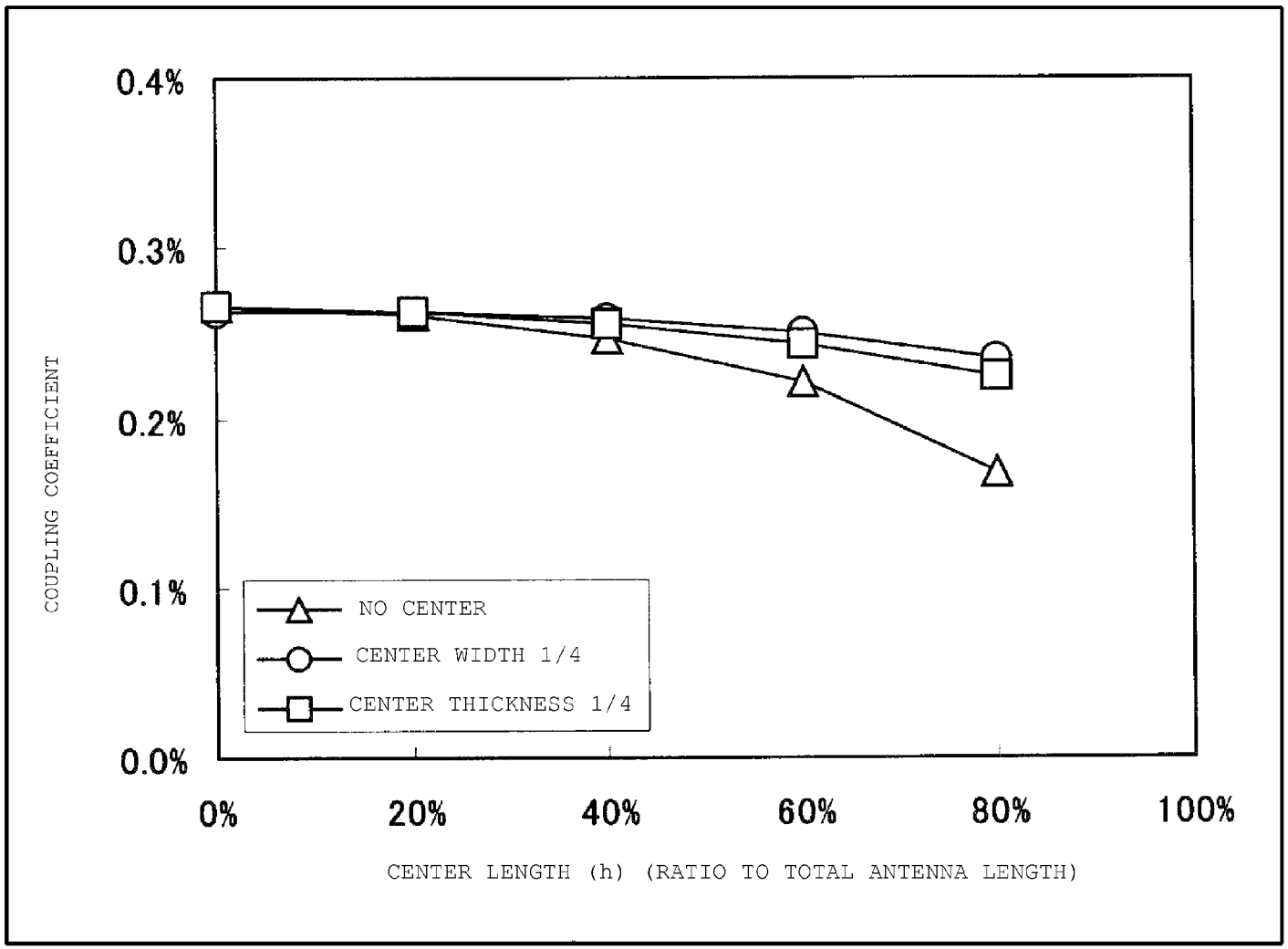
FIG. 11 is a view showing the relationship between the distance between a first magnetic core and a second magnetic core and the coupling coefficient of magnetic flux in a first experiment.
Figure 12:
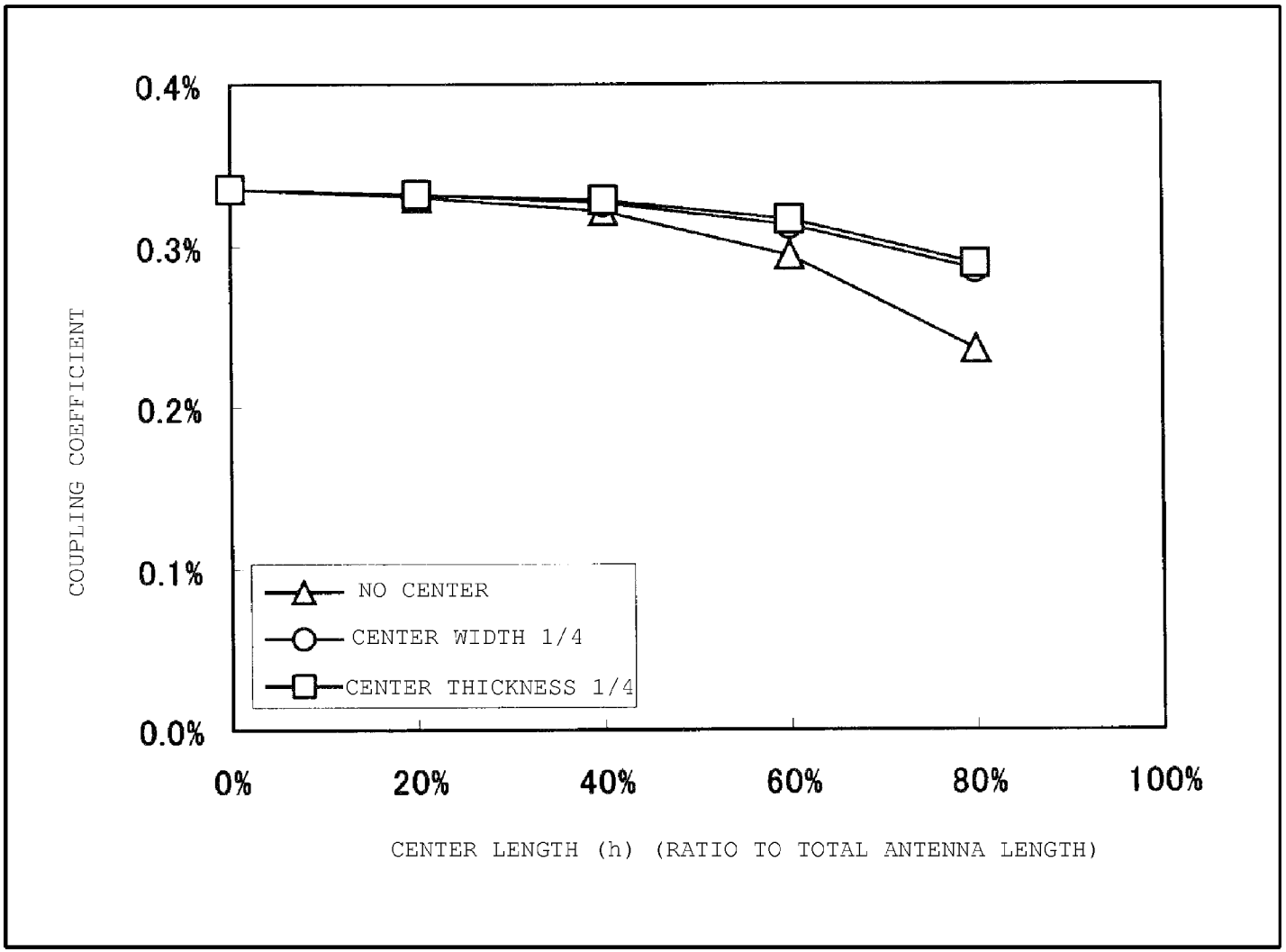
FIG. 12 is a view showing the relationship between the distance between the first magnetic core and the second magnetic core and the coupling coefficient of magnetic flux in the second experiment.

FIGS. 11 and 12 are views showing changes in coupling coefficient between the antenna device and the magnetic flux from the reader/writer made when the length of the non-winding portion changes. FIG. 11 shows the result of a first experiment, and FIG. 12 shows the result of a second experiment. In FIGS. 11 and 12, h represents the ratio of the distance between the first magnetic core and the second magnetic core to the length of the antenna coil in the coil axis direction.

In the first experiment, a circuit board having a principal surface with a lateral length of about 40 mm and a longitudinal length of about 90 mm and an antenna coil with a lateral length of about 40 mm, a longitudinal length of about 10 mm, and a thickness of about 1 mm, for example, are preferably used. Structures of the antenna coil other than the lengths are similar to those adopted in the first preferred embodiment. In the antenna coil, a first coil portion and a second coil portion are arranged so that a magnetic core is exposed by about 1 mm at each side, and each coil portion includes seven turns of a coil conductor wound with a pitch of about 0.2 mm, for example. Each magnetic core is preferably formed of a ferrite material having a magnetic permeability (μ) of 70 and a dielectric loss tangent (tan δ) of about 0.01. Under this condition, the distance between the first magnetic core and the second magnetic core was changed. In the first experiment, in three patterns, that is, in a pattern in which the antenna coil did not have a third magnetic core, a second pattern in which the antenna coil included a third magnetic core having a thickness equal to one-fourth the thickness of the first and second magnetic cores, and a third pattern in which the antenna coil included a third magnetic core having a longitudinal length equal to about one-fourth the longitudinal length of the first and second magnetic cores, the coupling coefficient was measured while the distance between the antenna coil and the reader/writer was set at about 100 mm. FIG. 11 shows the experiment results in the patterns.

In the second experiment, a circuit board having a principal surface with a lateral length of about 45 mm and a longitudinal length of about 90 mm and an antenna coil with a lateral length of about 45 mm, a longitudinal length of about 10 mm, and a thickness of about 1 mm, for example, are preferably used. Structures of the antenna coil other than the lengths are similar to those adopted in the first preferred embodiment. In the antenna coil, a first coil portion and a second coil portion are arranged so that a magnetic core is exposed by about 1 mm at each side, and each coil portion includes seven turns of a coil conductor wound with a pitch of about 0.22 mm. Each magnetic core is preferably formed of a ferrite material similar to that adopted in the first experiment. Similarly to the first experiment, the coupling coefficient was measured in the three patterns while the distance between the antenna coil and the reader/writer was set at about 100 mm. FIG. 12 shows the experiment results in the patterns.

As shown in FIG. 11, in the case in which the antenna coil does not have a third magnetic core, when the distance between the first magnetic core and the second magnetic core is increased, the coupling efficiency becomes much lower than in the other two patterns. However, even when the distance between the first magnetic core and the second magnetic core is about 60% of the length of the antenna coil, a coupling coefficient of about 0.22% is achieved. That is, an obtained coupling coefficient is higher than about 80% of the coupling coefficient obtained when there is no gap between the first and second magnetic cores. Therefore, it is revealed that the magnetic flux from the reader/writer can be captured and a coupling coefficient that is high enough to establish communication can be obtained even when a magnetic core is not provided in a portion between the first and second magnetic cores where the magnetic flux enters.

As shown in FIG. 12, in the second experiment, in a case in which the distance between the first and second magnetic cores is about 60% of the length of the antenna coil, even when the antenna coil does not have a third magnetic core, a coupling coefficient of about 0.29% is achieved, and a high coupling coefficient larger than about 80% of the coupling coefficient obtained when there is no gap between the first and second magnetic cores can be obtained.

According to the results of the first and second experiments, it can be said that the antenna coil properly interlinks with the magnetic flux that is perpendicular or substantially perpendicular to the coil axis direction of the antenna coil and a high antenna sensitivity is achieved as long as the condition that $0.6A \geq B$ is satisfied where A represents the length of the antenna coil in the coil axis direction and B represents the distance between the first and second magnetic cores.

The volume of the antenna coil can be considerably reduced by further satisfying the condition that $B \geq 0.4A$.

Fifth Preferred Embodiment

Figure 13:
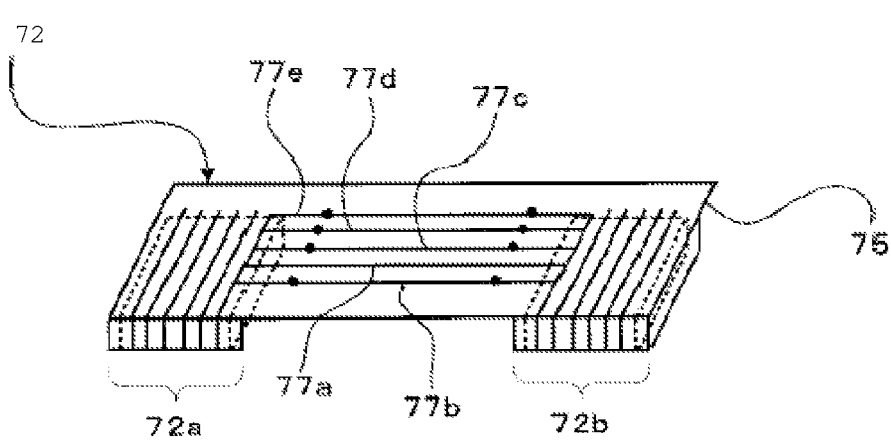
FIG. 13 is a perspective view showing a structure of an antenna coil to be mounted on a circuit board according to a fifth preferred embodiment of the present invention.

A structure of an antenna coil according to a fifth preferred embodiment will be described with reference to FIG. 13. FIG. 13 is a perspective view showing a structure of an antenna coil 72 including five connecting conductors 77. A first coil portion 72*a* and a second coil portion 72*b* are connected by five connecting conductors 77*a*, 77*b*, 77*c*, 77*d*, and 77*e* provided on a flexible board 75, and the connecting conductors are spaced equally. Other structures of the antenna coil other than the connecting conductors conform to those adopted in the first preferred embodiment. When four of the five connecting conductors are cut with, for example, a router or a laser, one path of a current from the first coil portion or the second coil portion is determined. The length of the conductor that forms the coil portions of the antenna coil is changed by the path. When the connecting conductor 77*a* is selected as the current path by cutting the connecting conductors 77*b*, 77*c*, 77*d*, and 77*e*, the conductor is shortest. Conversely, when the connecting conductor 77*e* is selected as the current path by cutting the connecting conductors 77*a*, 77*b*, 77*c*, and 77*d*, the conductor is longest.

Experimental Example

Table 1 shows the relationship between the path and the inductance and the change rates of inductance in the paths with reference to the inductance obtained when the connecting conductor 77*a* is selected as the path in the antenna coil 72 according to the fifth preferred embodiment. As shown in Table 1, the inductance increases as the path changes from the connecting conductor 77*a* to the connecting conductor 77*e* and the length of the conductor that forms the coil portions increases. When the path 77*e* is selected, an inductance that is changed by about 11.41% from the inductance obtained when the path 77*a* is selected can be obtained. That is, the inductance can be changed within a range of approximately 11%, depending on which of the connecting conductors 77*a*, 77*b*, 77*c*, 77*d*, and 77*e* is selected as the path.

TABLE 1

| Path | Inductance | Change Rate (%) |
|---|---|---|
| 77a | 1.1721 | 0.00 |
| 77b | 1.2077 | 3.03 |
| 77c | 1.2331 | 5.20 |
| 77d | 1.2736 | 8.66 |
| 77e | 1.3059 | 11.41 |

By changing the inductance of the antenna coil, the resonant frequency of a resonant circuit constituted by the antenna coil and a capacitance can be adjusted. In the antenna coil, originally, electric power is induced by changes in the magnetic flux passing through the coil portions, regardless of the resonant frequency. However, particularly when the resonant frequency coincides with the frequency of the entering magnetic flux, a high voltage is induced. Therefore, the produced voltage is increased and communication sensitivity of the antenna is improved by adjusting the resonant frequency of the resonant circuit to a desired value. In the antenna coil 72 having the structure shown in FIG. 13, since the inductance can be selected after the antenna coil is produced, the communication sensitivity of the antenna can be improved with great ease.

In the antenna coil 72 shown in FIG. 13, the connecting conductors 77*a*, 77*b*, 77*c*, 77*d*, and 77*e* are provided in the non-winding portion which magnetic flux from the reader/writer enters. While these connecting conductors can hinder the entry of the magnetic flux, since the ratio of the area of the portion where the connecting conductors are provided to the area of the non-winding portion is considerably low, the magnetic flux seems to enter smoothly.

Modifications

Figure 14A:
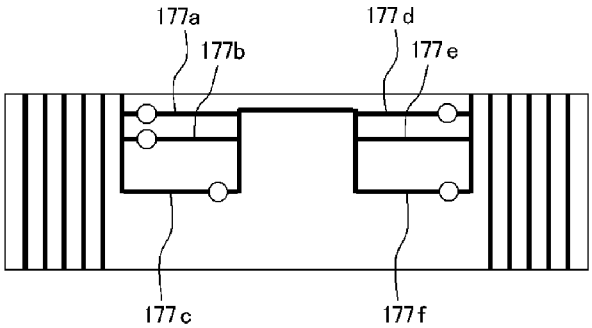
FIGS. 14A-14C include plan views showing structures of other antenna coil to be mounted on a circuit boards according to the fifth preferred embodiment of the present invention.
Figure 14B:
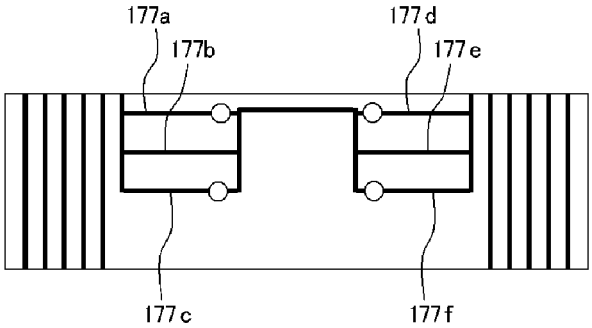
Figure 14C:
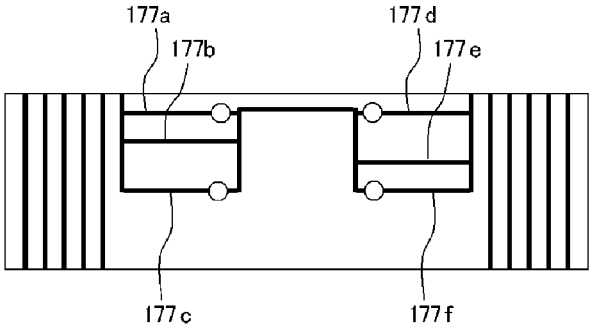

Modifications of the antenna coil according to the fifth preferred embodiment will be described with reference to FIGS. 14A-14C. FIGS. 14A-14C include plan views of modifications of the antenna coil according to the fifth preferred embodiment. In FIGS. 14A-14C, two units of connecting conductors are connected, and each unit is shaped like a squared-off figure "8". Herein, a unit shaped like a squared-off figure "8" by connecting conductors 177*a*, 177*b*, and 177*c* is referred to as a first connecting portion, and a unit shaped like a squared-off figure "8" by connecting conductors 177*d*, 177*e*, and 177*f* is referred to as a second connecting portion. Among the connecting conductors 177*a*, 177*b*, 177*c*, 177*d*, 177*e*, and 177*f*, when two of the connecting conductors that define each of the first and second connecting portions are cut, one path is determined. The length of the conductor that defines the coil portions of the antenna coil is determined by the path.

The first and second connecting portions defined by the connecting conductors 177*a*, 177*b*, 177*c*, 177*d*, 177*e*, and 177*f* can have the following four shapes.

In a first shape, three connecting conductors that define each connecting portion are equally spaced, and the first connecting portion and the second connecting portion have the same shape and the same size, as shown in FIG. 14B. In this shape, for example, the length of the conductor that forms the antenna coil is equal among a case in which the connecting conductors 177*b* and 177*e* serve as paths, a case in which the connecting conductors 177*a* and 177*f* serve as paths, and a case in which the connecting conductors 177*c* and 177*d* serve as paths. For this reason, the conductor can have five lengths, that is, (paths 177*a*-177*d*), (paths 177*a*-177*e*, 177*b*-177*d*), (paths 177*a*-177*f*, 177*c*-177*d*), (paths 177*b*-177*f*, 177*c*-177*e*), and (paths 177*c*-177*f*).

In a second shape, three connecting conductors that define each connecting portion are not equally spaced, and the first connecting portion and the second connecting portion have the same shape, as shown in FIG. 14A. For example, when the connecting conductors 177*a*, 177*b*, 177*c*, 177*d*, 177*e*, and 177*f* are formed so that (the distance between the connecting conductors 177*a* and 177*b*): (the distance between the connecting conductors 177*b* and 177*c*)=1:2 and so that (the distance between the connecting conductors 177*d* and 177*e*): (the distance between the connecting conductors 177*e* and 177*f*)=1:2, the conductor can have six lengths, that is, (paths 177*a*-177*d*), (paths 177*a*-177*e*, 177*b*-177*d*), (paths 177*a*-177*f*, 177*c*-177*d*), (paths 177*b*-177*e*), (paths 177*b*-177*f*, 177*c*-177*e*), and (paths 177*c*-177*f*).

In a third shape, three connecting conductors that define each connecting portion are not equally spaced, and the first connecting portion and the second connecting portion have different shapes, as shown in FIG. 14C. The distance between the connecting conductors 177*a* and 177*c* in the first connecting portion is equal to the distance between the connecting conductors 177*d* and 177*f* in the second connecting portion. For example, when the connecting conductors 177*a*, 177*b*, 177*c*, 177*d*, 177*e*, and 177*f* are formed so that (the distance between the connecting conductors 177*a* and 177*b*): (the distance between the connecting conductors 177*b* and 177*c*) =1:2 and so that (the distance between the connecting conductors 177*d* and 177*e*): (the distance between the connecting conductors 177*e* and 177*f*)=2:1, the conductors can have seven lengths, that is, (paths 177*a*-177*d*), (paths 177*a*-177*e*), (paths 177*a*-177*f*, 177*b*-177*e*, 177*c*-177*d*), (paths 177*b*-177*d*), (paths 177*b*-177*f*), (paths 177*c*-177*e*), and (paths 177*c*-177*f*).

With these shapes, the number of length patterns of the conductor can be increased without changing the number of connecting conductors, and the inductance of the antenna coil can be adjusted more finely.

In a fourth shape, the connecting conductors are arranged at different intervals. With this shape, the conductor that defines the coil portions of the antenna coil can have nine lengths. Therefore, the adjustable range of the inductance is increased further.

As described above, the number of length variations of the conductor is increased and fine adjustment of the inductance is allowed by forming the connecting conductors in the shape of a squared-off figure "8". Further, when two units shaped like a squared-off figure "8" are provided and a gap is formed therebetween, the connecting conductors are not provided in the center of the antenna coil. Therefore, the connecting conductors do not hinder the entry of magnetic flux, and the magnetic flux enters the non-winding portion more easily than in the antenna coil shown in FIG. 13. The shapes of the connecting conductors are not limited to those adopted in this preferred embodiment.

Sixth Preferred Embodiment

In an antenna device according to a sixth preferred embodiment, an antenna coil to be mounted on a circuit board is mounted on a circuit board with a space therebetween. A characteristic that electrodes are provided on a surface of the antenna coil to be mounted on a circuit board facing the circuit board is peculiar to this preferred embodiment. Other structures that will not be described in the following examples conform to those adopted in the first preferred embodiment. However, a projection for connection to an input/output terminal is not provided.

First Example

Figure 15A:
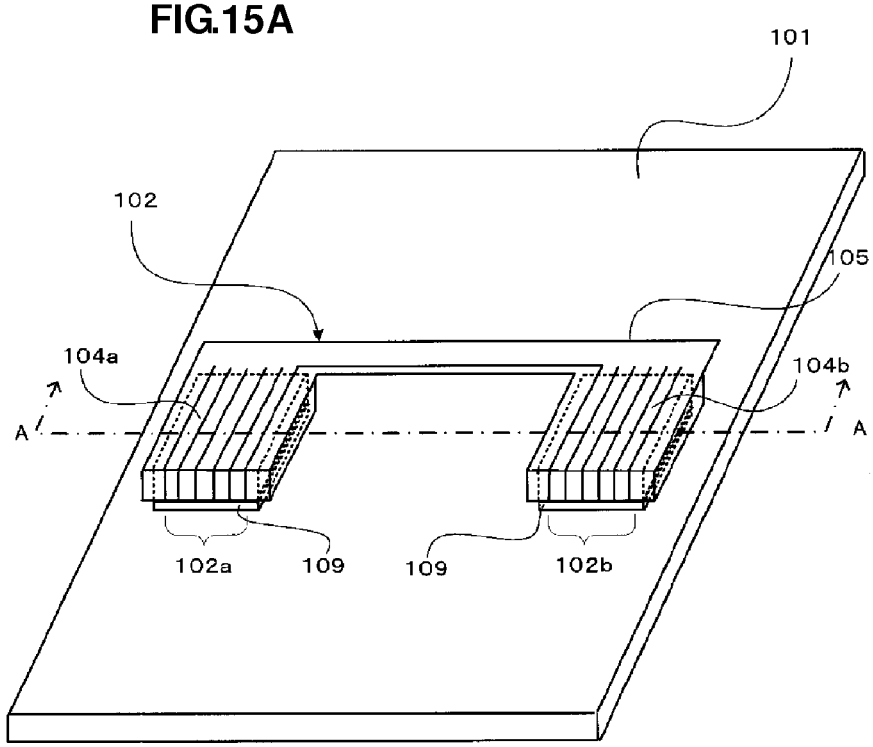
FIGS. 15A and 15B are a perspective view and a plan view, respectively, showing a configuration of an antenna device according to a sixth preferred embodiment of the present invention.

A configuration of an antenna device according to a first example will be described with reference to FIGS. 15A and 15B. FIG. 15A is a plan view showing the configuration of the antenna device of the first example, and FIG. 15B is a cross-sectional view, taken along line A-A in FIG. 15A.

Figure 15B:
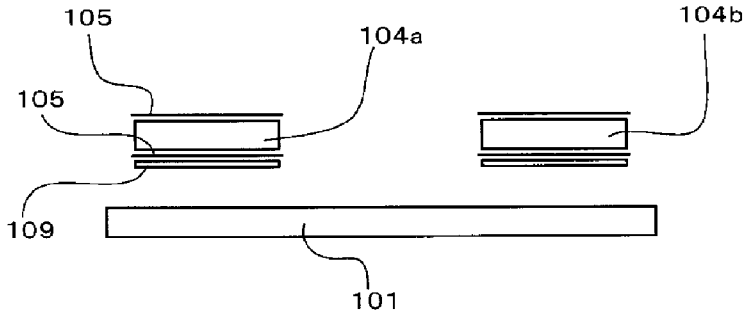

As shown in FIGS. 15A and 15B, an antenna coil 102 is mounted on a circuit board 101 with a space therebetween. In the antenna coil 102, electrodes 109 are provided on surfaces of a first magnetic core 104*a* and a second magnetic core 104*b* facing the circuit board 101. Principal surfaces of the electrodes 109 and principal surfaces of the first and second magnetic cores 104*a* and 104*b* have the same shape and the same size. The principal surfaces of the electrodes 109 completely coincide with the principal surfaces of the first and second magnetic cores 104*a* and 104*b*.

For example, the circuit board 101 has a substantially rectangular principal surface having a length of about 90 mm and a width length of about 50 mm. The antenna coil 102 is arranged so that the lateral direction of the antenna coil 102 is parallel or substantially parallel to the lengthwise direction of the circuit board 101. The space provided between the circuit board 101 and the antenna coil 102 is preferably about 1 mm.

Advantages obtained by this structure will be described below. As described in the second preferred embodiment, magnetic flux entering a coil-conductor non-winding portion provided between the first and second magnetic cores 104*a* and 104*b* of the antenna coil 102 is blocked by the circuit board 101 that is disposed behind the antenna coil 102 and has conductivity, and its traveling direction is changed. The magnetic flux then enters the first and second magnetic cores 104*a* and 104*b*. When a space is provided between the circuit board 101 and the antenna coil 102, magnetic flux entering the first magnetic core 104*a* and the second magnetic core 104*b* may be radiated from the surfaces of the first and second magnetic cores 104*a* and 104*b* facing the circuit board 101. When the magnetic flux is thus radiated from the surfaces facing the circuit board 101, it cannot pass through the first and second coil portions 102*a* and 102*b*. Therefore, electromagnetic induction cannot be caused, or an induced voltage is markedly low. However, since the electrodes 109 are provided on the surfaces of the first and second magnetic cores 104*a* and 104*b* facing the circuit board 101 in this preferred embodiment, radiation of magnetic flux can be prevented. Accordingly, the antenna coil can interlink with the magnetic flux in a direction that is perpendicular or substantially perpendicular to the principal surface of the antenna coil 102, and a voltage can be produced in the coil constituted by the first and second coil portions 102*a* and 102*b*.

Second Example

Figure 16A:
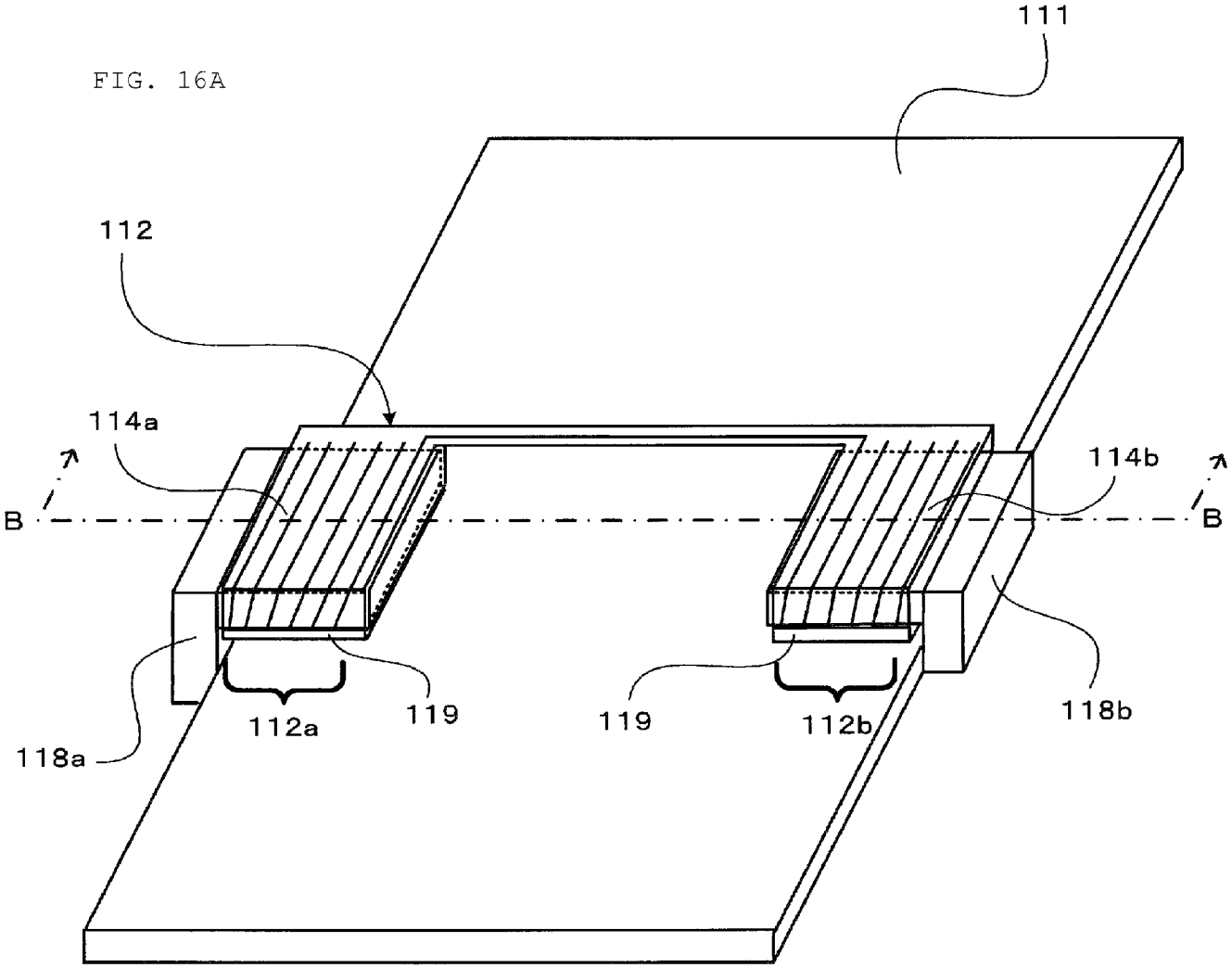
FIGS. 16A and 16B are a perspective view and a plan view, respectively, showing a configuration of an antenna device according to the sixth preferred embodiment of the present invention.

A configuration of an antenna device according to a second example will be described with reference to FIGS. 16A and 16B. FIG. 16A is a plan view showing the configuration of the antenna device of the second example, and FIG. 16B is a cross-sectional view, taken along line B-B in FIG. 16A.

Figure 16B:
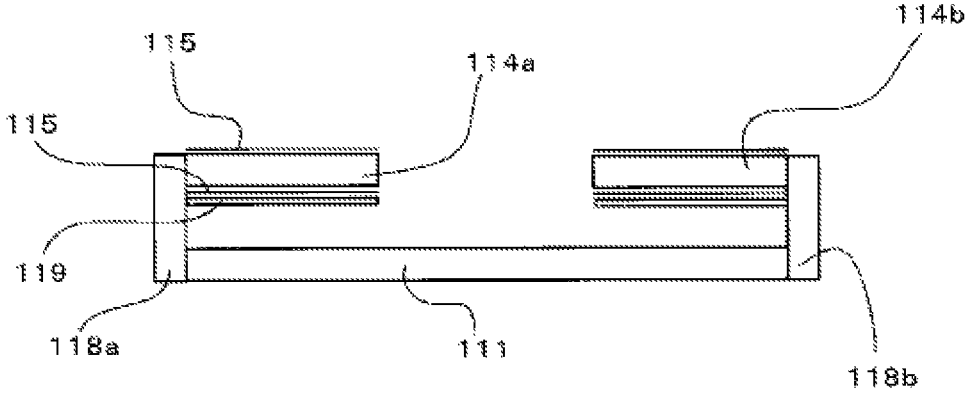
Figure 17:
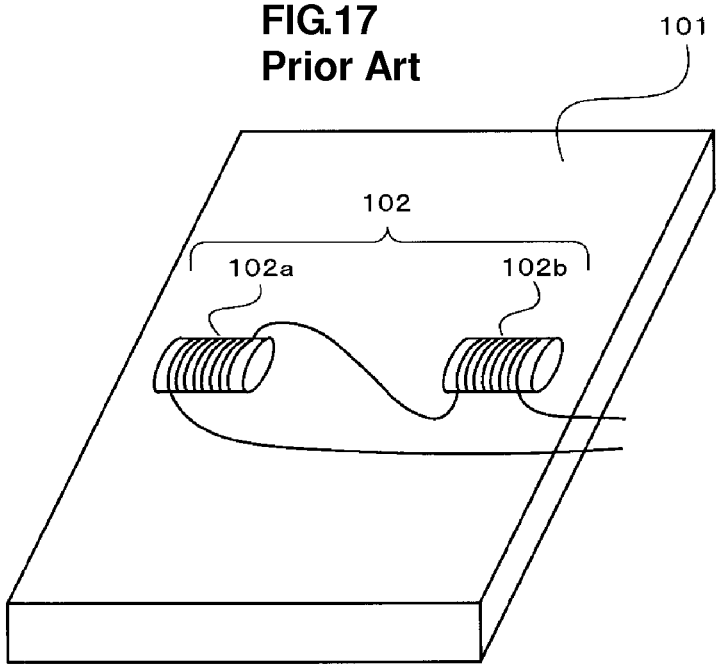
FIG.17 Prior Art
FIG. 17 is a perspective view showing a configuration of a conventional antenna device.

As shown in FIGS. 16A and 16B, an antenna coil 112 is mounted on a circuit board 111 with a space therebetween. In the antenna coil 112, magnetic cores 118*a* and 118*b* extending perpendicular or substantially perpendicular to the coil axis direction are respectively connected to end surfaces of first and second magnetic cores 114*a* and 114*b* on outer sides in the coil axis direction. The first and second magnetic cores and a flexible board are formed in a method that conforms to that adopted in the first preferred embodiment. The distance between the outer end of the first magnetic core and the outer end of the second magnetic core is about 45 mm. However, a projection for connection to an input/output terminal is not provided. The magnetic cores 118*a* and 118*b* preferably are about 10 mm in longitudinal length, about 1 mm in lateral length, and about 3.5 mm in thickness, for example. The magnetic core 118*a* is bonded to the end surface of the first magnetic core 114*a* in the coil axis direction. The longitudinal side of the magnetic core 118*a* coincides with the longitudinal side of the first magnetic core 114*a*, and the lateral side of the magnetic core 118*b* and the lateral side of the first magnetic core 114*a* lie on the same straight line. Similarly, the magnetic core 118*b* is bonded to the end surface of the second magnetic core 114*b*. Electrodes 119 are provided on surfaces of the first and second magnetic cores 114*a* and 114*b* facing the circuit board 111, and cover the entire surfaces of the magnetic cores 114*a* and 114*b*.

The circuit board 111 is preferably formed of copper, and is about 90 mm in length, about 45 mm in width, and about 1 mm in thickness, for example. The antenna coil 112 is arranged so that the lateral direction of the antenna coil 112 is parallel or substantially parallel to the lengthwise direction of the circuit board 111. The space between the circuit board 111 and the antenna coil 112 is preferably about 1 mm, for example. When the antenna coil 112 is thus mounted on the circuit board 111, the magnetic cores 118*a* and 118*b* connected to the ends of the antenna coil 112 are disposed along side surfaces of the circuit board 111.

With this structure, magnetic flux entering a non-winding portion of the antenna coil 112 passes through the first and second coil portions 112*a* and 112*b*. Since the electrodes are provided on the first and second magnetic cores 114*a* and 114*b*, even when the space is provided between the antenna coil 112 and the circuit board 111, the magnetic flux is not radiated without passing through the first and second coil portions 112*a* and 112*b*. The magnetic flux passing through the first and second coil portions 112*a* and 112*b* enters the magnetic cores 118*a* and 118*b* connected thereto, and is radiated from the side surfaces of the magnetic cores 118*a* and 118*b*.

Since the magnetic cores are provided at the ends of the antenna coil 112 in this preferred embodiment, magnetic resistances at the ends decrease. For this reason, the magnetic flux passing through the first and second coil portions 112*a* and 112*b* increases, and the voltage induced by the magnetic flux increases. Therefore, more sensitive communication is possible.

In this preferred embodiment, as described above, since the electrodes are provided on the surface of the antenna coil facing the circuit board, even when a space is provided between the antenna coil and the circuit board, highly sensitive communication with the reader/writer can be achieved. Therefore, when an antenna device including an antenna coil and a circuit board is mounted in a mobile terminal, the antenna coil can be bonded to a housing of the mobile terminal so that a space is formed between the antenna coil and the circuit board. When the above-described antenna device is mounted in a twofold mobile terminal including a main housing and a sub housing, the circuit board can be placed on the main housing and the antenna coil can be placed on the sub housing so that the circuit board is disposed behind the antenna coil in a folded state of the mobile terminal, as viewed from the side of the reader/writer. By thus mounting the antenna coil having the electrodes on the circuit board with a space therebetween, the degree of flexibility in designing the mounting position of the antenna device in the mobile terminal is increased.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. An antenna coil provided on a circuit board comprising:

a first magnetic core including a flat plate shaped portion;

a second magnetic core including a flat plate shaped portion and being juxtaposed to the first magnetic core with a space therebetween;

a first coil portion arranged around the first magnetic core;

a second coil portion arranged around the second magnetic core such that a coil axis direction of the second coil portion coincides with a coil axis direction of the first coil portion, and such that a coil winding direction of the second coil portion is opposite to a coil winding direction of the first coil portion;

the coil axis direction of each of the first coil portion and the second coil portion extends in a direction along a main surface of the circuit board; and a connecting conductor arranged so as to connect the first coil portion and the second coil portion; wherein an end of the first coil portion is disposed adjacent to a first outside end of the circuit board and an end of the second coil portion is disposed adjacent to a second outside end of the circuit board opposite to the first outside end of the circuit board;

an end of the first magnetic core is aligned with an end of the circuit board such that the end of the first magnetic core and the end of the circuit board are coplanar with one another; and an end of the second magnetic core is aligned with another end of the circuit board such that the end of the second magnetic core and the another end of the circuit board are coplanar with one another.

2. The antenna coil according to claim 1, wherein the following condition is satisfied:

$$0.6A \geq B \geq 0.4A$$

where A represents the length of the antenna coil in the coil axis direction and B represents the distance between the first magnetic core and the second magnetic core.

3. The antenna coil according to claim 1, wherein the first magnetic core and the second magnetic core have the same shape.

4. The antenna coil according to claim 3, wherein the first magnetic core and the second magnetic core are juxtaposed so that principal surfaces thereof face in the same direction.

5. The antenna coil according to claim 1, wherein a magnetic core is connected to at least one of outer ends of the first magnetic core and the second magnetic core in the coil axis direction.

6. The antenna coil according to claim 1, wherein the first coil portion and the second coil portion have an equal number of coil turns.

7. The antenna coil according to claim 1, wherein the first coil portion and the second coil portion have a different number of coil turns.

8. The antenna coil according to claim 1, wherein the connecting conductor includes at least two connecting conductors.

9. The antenna coil according to claim 1, wherein an electrode is provided on one principal surface of the antenna coil.

10. The antenna coil according to claim 1, further comprising:

a third magnetic core configured to connect the first magnetic core and the second magnetic core;

wherein a cross-sectional area of the third magnetic core that is substantially perpendicular to a direction in which the first and second magnetic cores are juxtaposed is smaller than cross-sectional areas of the first and second magnetic cores.

11. An antenna coil provided on a circuit board comprising:

a first magnetic core including a flat plate shaped portion;

a second magnetic core including a flat plate shaped portion and being juxtaposed to the first magnetic core with a space therebetween;

a first coil portion arranged around the first magnetic core;

a second coil portion arranged around the second magnetic core such that a coil axis direction of the second coil portion coincides with a coil axis direction of the first coil portion, and such that a coil winding direction of the second coil portion is opposite to a coil winding direction of the first coil portion;

the coil axis direction of each of the first coil portion and the second coil portion extends in a direction along a main surface of the circuit board; and a connecting conductor arranged so as to connect the first coil portion and the second coil portion; wherein an end of the first coil portion is disposed adjacent to a first outside end of the circuit board and an end of the second coil portion is disposed adjacent to a second outside end of the circuit board opposite to the first outside end of the circuit board;

an end of the first magnetic core is arranged to extend perpendicularly to the flat plate shaped portion of the first magnetic core, the end of the first magnetic core being disposed along and opposed to a first side surface of the circuit board; and an end of the second magnetic core is arranged to extend perpendicularly to the flat plate shaped portion of the second magnetic core, the end of the second magnetic core being disposed along and opposed to a second side surface of the circuit board.

12. The antenna coil according to claim 11, wherein the following condition is satisfied:

$$0.6A \geq B \geq 0.4A$$

where A represents the length of the antenna coil in the coil axis direction and B represents the distance between the first magnetic core and the second magnetic core.

13. The antenna coil according to claim 11, wherein the first magnetic core and the second magnetic core have the same shape.

14. The antenna coil according to claim 13, wherein the first magnetic core and the second magnetic core are juxtaposed so that principal surfaces thereof face in the same direction.

15. The antenna coil according to claim 11, wherein a magnetic core is connected to at least one of outer ends of the first magnetic core and the second magnetic core in the coil axis direction.

16. The antenna coil according to claim 11, wherein the first coil portion and the second coil portion have an equal number of coil turns.

17. The antenna coil according to claim 11, wherein the first coil portion and the second coil portion have a different number of coil turns.

18. The antenna coil according to claim 11, wherein the connecting conductor includes at least two connecting conductors.

19. The antenna coil according to claim 11, wherein an electrode is provided on one principal surface of the antenna coil.

20. The antenna coil according to claim 11, further comprising:

a third magnetic core configured to connect the first magnetic core and the second magnetic core;

wherein a cross-sectional area of the third magnetic core that is substantially perpendicular to a direction in which the first and second magnetic cores are juxtaposed is smaller than cross-sectional areas of the first and second magnetic cores.

* * * * *